US008944279B2

(12) United States Patent
Shoaf et al.

(10) Patent No.: US 8,944,279 B2
(45) Date of Patent: Feb. 3, 2015

(54) WET WIPE DISPENSER WITH IMPROVED ARC-SHAPED DISPENSING PARTITION

(75) Inventors: Timothy Walter Shoaf, Appleton, WI (US); Andrew Dale Brinkdopke, West Chester, OH (US); Robert Samuel Schlaupitz, New London, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 643 days.

(21) Appl. No.: 12/976,023

(22) Filed: Dec. 22, 2010

(65) Prior Publication Data

US 2012/0160864 A1 Jun. 28, 2012

(51) Int. Cl.
*A47K 10/24* (2006.01)
*B65H 1/00* (2006.01)

(52) U.S. Cl.
USPC ..... 221/45; 221/46; 221/34; 221/282; 221/48; 221/62; 221/63; 206/210; 206/20; 206/812

(58) Field of Classification Search
CPC ..... A47K 10/24; B65H 1/00
USPC ..... 221/46, 34, 45, 282, 48, 62, 63; 206/210, 20, 812
See application file for complete search history.

(56) References Cited

U.S. PATENT DOCUMENTS

| | | | | |
|---|---|---|---|---|
| 2,744,666 | A * | 5/1956 | Jacobs et al. | 222/545 |
| 3,095,991 | A * | 7/1963 | Paniagua | 215/303 |
| 3,383,012 | A * | 5/1968 | Adell | 221/46 |
| 3,637,109 | A * | 1/1972 | Stifter | 221/310 |
| 3,749,296 | A * | 7/1973 | Harrison | 225/106 |
| 3,780,908 | A | 12/1973 | Fitzpatrick et al. | |
| 3,795,355 | A | 3/1974 | Gerstein | |
| 3,868,052 | A | 2/1975 | Rockefeller | |
| 3,982,659 | A | 9/1976 | Ross | |
| 4,017,002 | A | 4/1977 | Doyle et al. | |
| 4,180,160 | A * | 12/1979 | Ogawa et al. | 206/210 |
| 4,648,530 | A * | 3/1987 | Granger | 221/34 |
| 4,651,895 | A | 3/1987 | Niske et al. | |
| 4,784,290 | A | 11/1988 | Howard | |
| 4,969,575 | A * | 11/1990 | Kobayashi | 221/45 |
| 5,265,785 | A * | 11/1993 | Chudy | 224/666 |
| 5,542,567 | A | 8/1996 | Julius | |
| 5,542,568 | A | 8/1996 | Julius | |
| 5,699,912 | A | 12/1997 | Ishikawa et al. | |
| 5,908,138 | A | 6/1999 | Vlahakis et al. | |

(Continued)

FOREIGN PATENT DOCUMENTS

| | | | |
|---|---|---|---|
| EP | 1 366 699 | A2 | 12/2003 |
| WO | WO 98/19946 | A1 | 5/1998 |

(Continued)

*Primary Examiner* — Rakesh Kumar
(74) *Attorney, Agent, or Firm* — Kimberly-Clark Worldwide, Inc.

(57) ABSTRACT

A container for storing personal care articles comprising a lid structure attached to the container is disclosed. The lid structure has a top lid portion connected to a base lid portion. The base lid portion includes a rigid port surrounding a unitary dispensing partition extending in an x and z direction to the rigid port, the unitary dispensing partition having a dispensing slit formed therethrough. The unitary dispensing partition forms an arc extending a first depth into the interior of the container in a z-direction. The depth of the dispensing partition allows for the personal care article to be stored in a pop-up dispensing position with a larger portion of the personal care article extending from the dispensing slit. This allows for easier retrieval of the product by a consumer and less dispensing failures.

14 Claims, 3 Drawing Sheets

(56) References Cited

U.S. PATENT DOCUMENTS

| | | | | |
|---|---|---|---|---|
| 6,409,044 | B1 | 6/2002 | Brown et al. | |
| 6,523,690 | B1 | 2/2003 | Buck et al. | |
| 6,585,131 | B2 | 7/2003 | Huang et al. | |
| 6,592,004 | B2 | 7/2003 | Huang et al. | |
| 6,766,919 | B2 * | 7/2004 | Huang et al. | 221/63 |
| 6,786,447 | B2 * | 9/2004 | Geib et al. | 242/588.3 |
| 6,910,579 | B2 * | 6/2005 | Reinke et al. | 206/494 |
| 6,951,292 | B2 * | 10/2005 | Bando et al. | 220/254.5 |
| 7,216,775 | B2 | 5/2007 | Evans et al. | |
| 7,731,057 | B2 | 6/2010 | Evans et al. | |
| 8,261,937 | B2 * | 9/2012 | Bodziak et al. | 221/45 |
| 2002/0036208 | A1 * | 3/2002 | Faulks et al. | 221/46 |
| 2002/0074375 | A1 | 6/2002 | Irwin | |
| 2002/0179627 | A1 * | 12/2002 | Huang et al. | 221/63 |
| 2005/0205594 | A1 | 9/2005 | Evans et al. | |
| 2007/0210098 | A1 | 9/2007 | Evans et al. | |
| 2009/0289077 | A1 | 11/2009 | Melin et al. | |
| 2009/0289078 | A1 | 11/2009 | Melin et al. | |
| 2009/0314793 | A1 * | 12/2009 | Reedy et al. | 221/45 |
| 2013/0240556 | A1 * | 9/2013 | Yamada | 221/63 |

FOREIGN PATENT DOCUMENTS

| | | | |
|---|---|---|---|
| WO | WO 2005/112556 | A2 | 12/2005 |
| WO | WO 2008/008742 | A1 | 1/2008 |

* cited by examiner

WET WIPE DISPENSER WITH IMPROVED ARC-SHAPED DISPENSING PARTITION

BACKGROUND

There are a variety of storing and dispensing containers in the market, particularly those for storing and dispensing personal care products. Personal care products, particularly wipes, have been made from a variety of materials which can be dry or wet when used. Wet wipes can be moistened with a variety of suitable wiping solutions. Typically, wet wipes have been stacked in a container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Sometimes the folded wet wipes have also been interfolded with the wet wipes immediately above and below in the stack of wet wipes. Wet wipes have also been placed in containers in the form of a continuous web of material which includes perforations to separate the individual wet wipes and which is wound into a roll. Such wet wipes have been used for baby wipes, hand wipes, household cleaning wipes, industrial wipes and the like.

The conventional containers which contain wipes have typically been designed to be positioned on a flat surface such as a countertop, table or the like. Such conventional packages have generally provided a plastic container, tub or package which provides a sealed environment for the wet wipes to ensure that they do not become dirty and/or overly dry. To access the wipes, many containers have an access lid that is opened by pressing a button on top of the container.

Some of these conventional packages have been configured to provide one at a time dispensing of each wet wipe which can be accomplished using a single hand after the container has been opened. Such single handed, one at a time dispensing is particularly desirable because the other hand of the user or care giver is typically required to be simultaneously used for other functions. For example, when changing a diaper product on an infant, the care giver typically uses one hand to hold and maintain the infant in a desired position while the other hand is attempting to dispense a wet wipe to clean the infant. The care giver may not want to look away from the infant to open the container and access the wipes.

A wide variety of wet wipes dispensing containers are available in the market today. These containers may be broadly categorized into two classes: reach-in and pop-up. Within the pop-up category, some containers provide a stack of flat interfolded wipes, which are most commonly dispensed from a tub. Other containers provide a roll of wipes, perforated at their edges, which are dispensed from an upright cylindrical container. The pop-up style containers have gained popularity because the wet wipe is more readily available to the user. Although there is a greater opportunity for the wipes in a pop-up style container to at least partially dry out, improvements in container design have mitigated this problem.

However, the dispensing of wipes from such conventional containers for wipes has not been completely satisfactory. For example, for pop-up style containers having a stack of wipes there are occasions where the pop-up feature fails and the user needs to reach into the container to retrieve the next wipe. These failures are most often caused by missed interfolds. Therefore, there is a need to provide a dispenser with a shaped dispensing partition which allows consumers access to the wipes for easier dispensing and less failures, particularly in a pop-up wipes product format.

SUMMARY

A container for storing personal care articles comprising a lid structure attached to the container is disclosed. The lid structure has a top lid portion connected to a base lid portion by at least one hinge, the top lid portion having a lid fastener mechanism extending from the opposing side of the hinge. The base lid portion base lid portion includes a rigid port surrounding a unitary dispensing partition extending in an x and y direction to the rigid port, the unitary dispensing partition having a dispensing aperture or slit formed therethrough.

Typically, the unitary dispensing partition forms an arc in the x-direction extending a first depth into an interior of the container in a z-direction. Desirably, the first depth of the unitary dispensing partition extends into the interior of the container in the z-direction by a distance of at least 5 mm. Even more desirably, the first depth of the unitary dispensing partition extends into the interior of the container in the z-direction by a distance of between about 5 and about 15 mm.

The dispensing aperture may include a continuous slit having two ends, the continuous slit extending a distance in an x-direction along the arc. In this case, the two ends of the continuous slit reside on the arc at a second depth in the z-direction which is less than the first depth.

The container stores a stack of wet wipes located inside the wet wipes dispenser, each wet wipe having a leading edge and a trailing edge. During storage, the leading edge of the wipe extends into a storage space between the dispensing partition and the lid top. Desirably, the dispensing partition is a flexible material. Typically, the dispensing partition is a thermoplastic elastomer.

Initiation of separation of a subsequent wipe may occur at a middle portion of the trailing edge of a first wipe. When this happens, separation of the subsequent wipe occurs at outer edge portions of the trailing edge of a first wipe while a middle portion leading edge of the subsequent wipe is held in place by the dispensing aperture. This results in less wipes falling back into the container and out of the dispensing position during use. Thus, the container will have less dispensing failures.

The container having the arc-shaped dispensing partition described herein has a dispensing failure rate of less than 8%.

BRIEF DESCRIPTION

DETAILED DESCRIPTION

Figure 1:
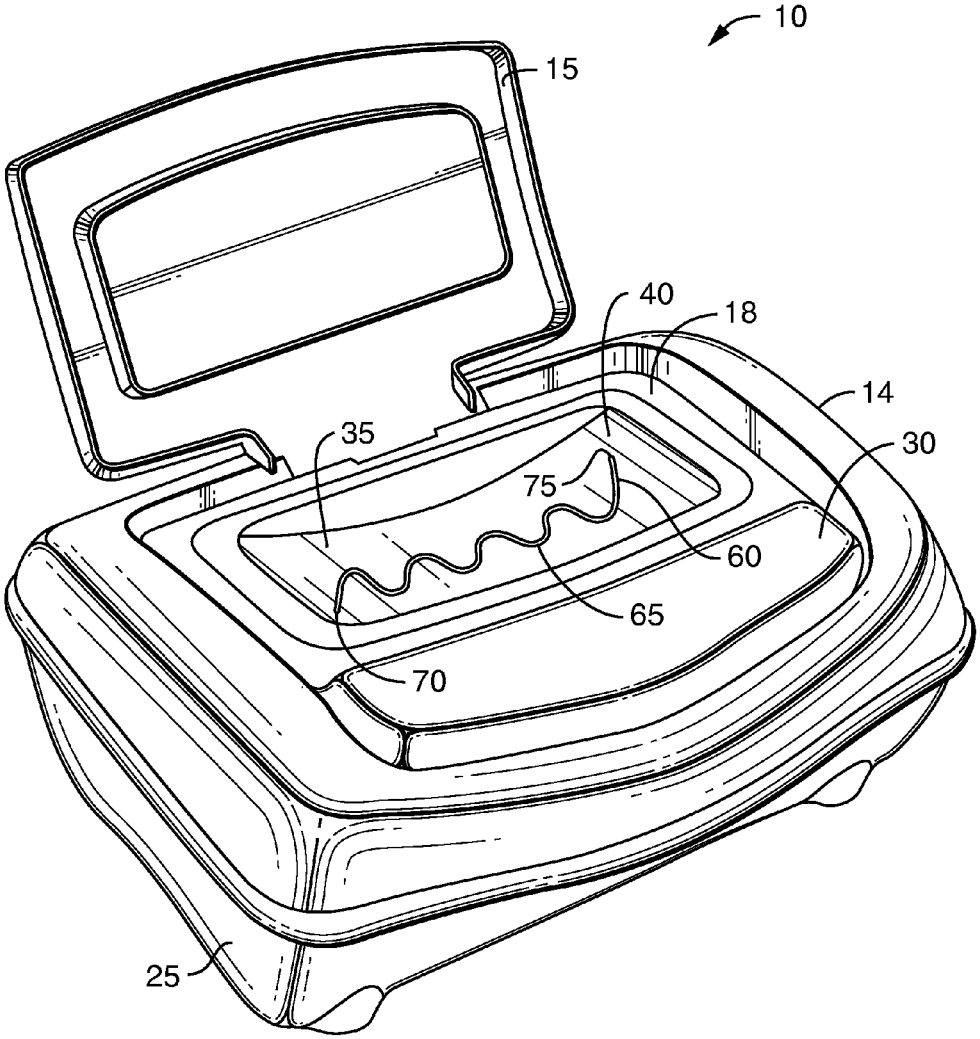
FIG. 1 illustrates a perspective view of an exemplary dispenser for personal care articles.

Generally stated, a container for storing personal care articles comprising a lid structure attached to the container is disclosed. The lid structure has a top lid portion connected to a base lid portion by at least one hinge, the top lid portion having a lid fastener mechanism extending from the opposing side of the hinge. The base lid portion includes a rigid port surrounding a unitary dispensing partition extending in an x and y direction to the rigid port, the unitary dispensing partition having a dispensing slit formed therethrough. The unitary dispensing partition forms an arc extending a first depth into an interior of the container in a z-direction. The depth of the dispensing partition allows for the personal care article to be stored in a pop-up dispensing position with a larger portion of the personal care article extending from the dispensing slit. This allows for easier retrieval of the product by a consumer and less dispensing errors.

Reference will now be made in detail to the presently preferred embodiments of the invention, one or more examples of which are illustrated in the drawings. Each example is provided by way of explanation and is not meant as a limitation. For example, features illustrated or described as part of one embodiment or figure can be used on another embodiment or figure to yield yet another embodiment. It is intended that the present disclosure include such modifications and variations.

Figure 2:
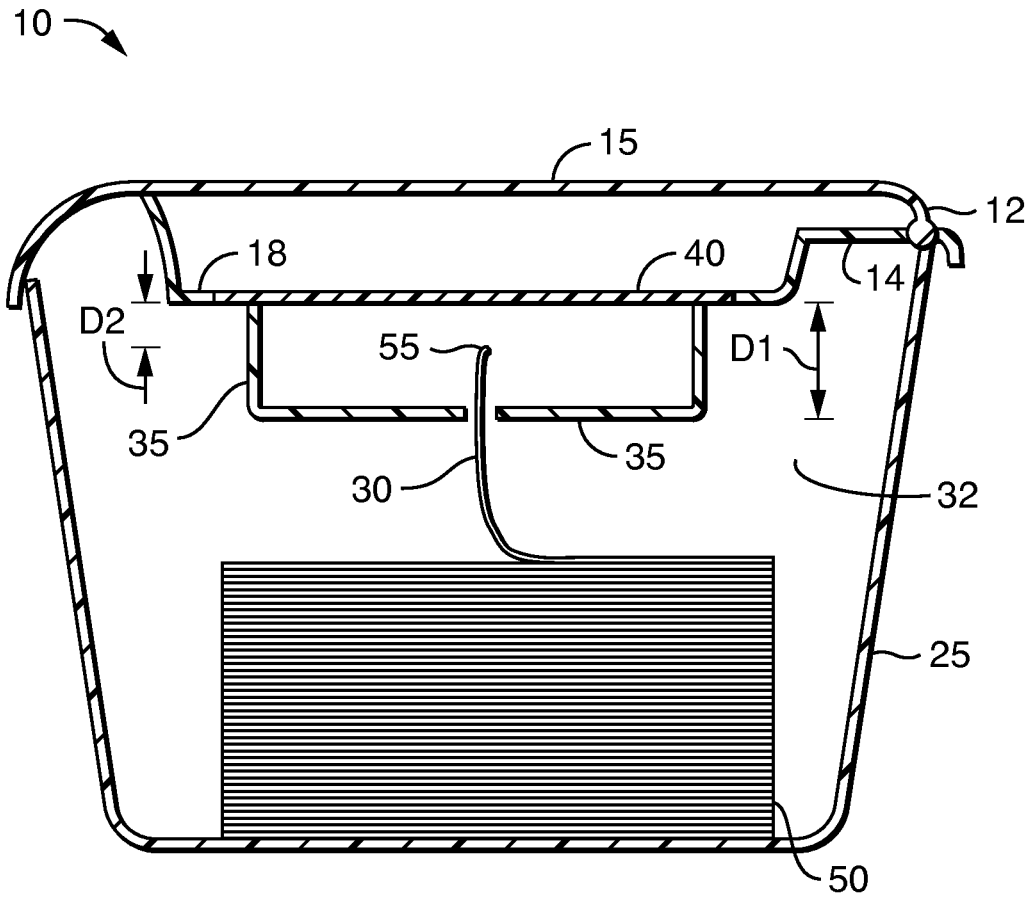
FIG. 2 illustrates a side cross-sectional view of the exemplary dispensing partition of the dispenser depicted in FIG. 1.
Figure 3:
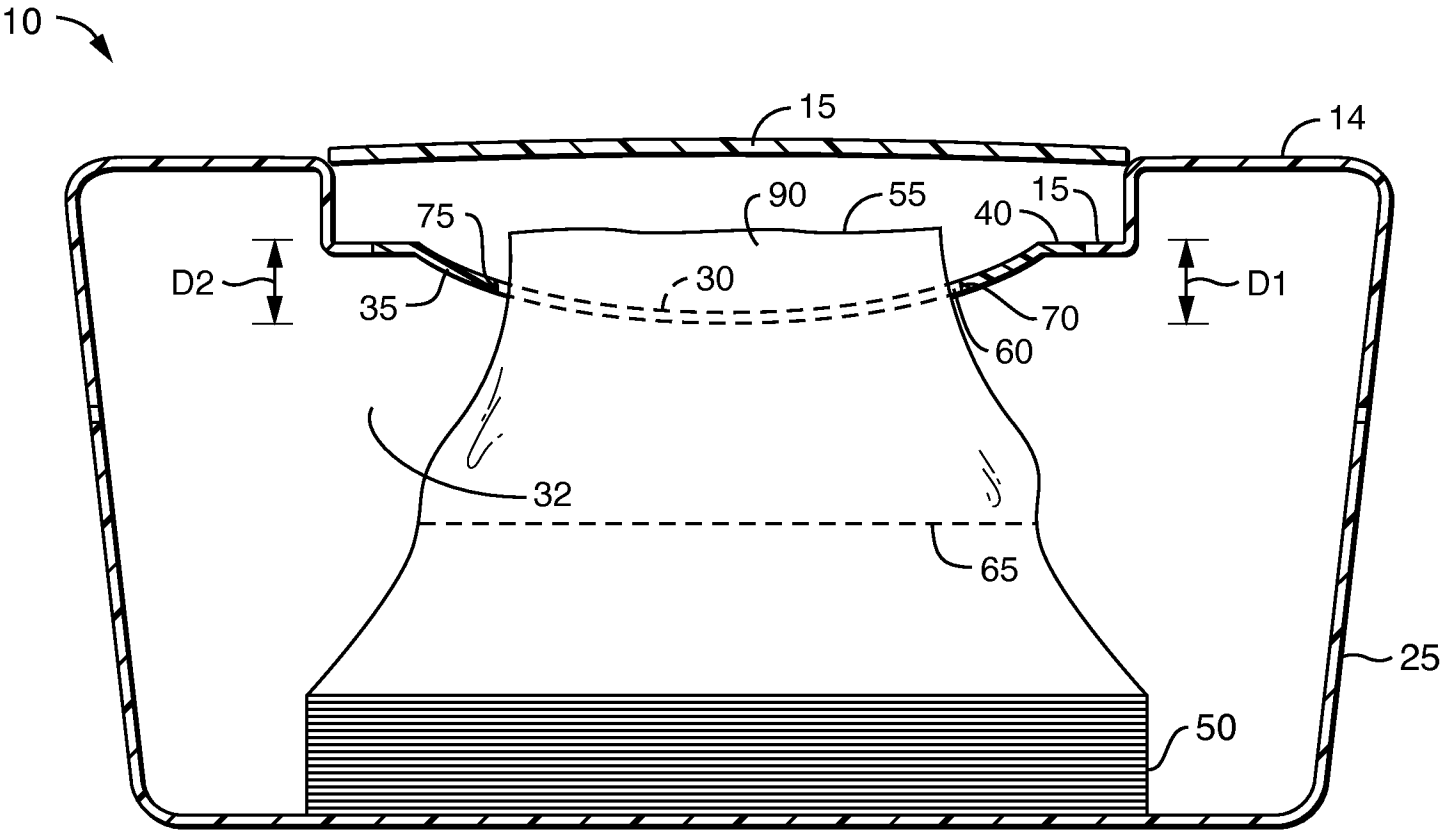
FIG. 3 illustrates a front cross-sectional view of the exemplary dispensing partition for personal care articles with a personal care article in the dispensing position.

As illustrated in FIGS. 1-3, a container 10 for storing personal care products having a lid structure 12 with a lid top 15 hingedly attached to a lid base 14 to allow a consumer access to contents of the container therethrough. A tension member is positioned against the lid top and lid base at the hinge. The tension member is formed by a band or strip of flexible rubber or plastic, such as silicone, and/or a metal spring. The end of the tension member forces against the lid top 15 to urge apart the lid top 15 and lid base 14 when a consumer pushes a lid-activation button 30 to open the lid structure 12.

In exemplary embodiments, the personal care products stored in the container are wet wipes that are used for baby wipes, hand wipes, household cleaning wipes, industrial wipes and the like. The lid structure 12 may be formed as an integral part of the container 10 or may be positioned over a lid base 14. In an exemplary embodiment, the lid base 14 is connected to a container base 25 by a hinge 22 to enable a second opening into the container 10. A consumer may then be able to, if desired, refill the container with additional wipes.

The product, e.g., wipes or wet wipes, can be arranged in the dispenser in any manner which provides convenient and reliable one at a time dispensing and which assists the wipes in not becoming dirty and/or overly dry. For example, the wipes may be arranged in the dispenser or container as a plurality of individual sheets arranged in a stacked configuration to provide a stack of wipes which may or may not be individually folded. The wipes may be individual wipes which are folded in a c-fold, z-fold, quarter fold or other zigzag fold or interfolded or non-interfolded configurations as are known to those skilled in the art. These configurations for wipes, as well as those discussed herein, may be provided by means known to those skilled in the art.

Desirably, the wipes can be arranged in the dispenser as a continuous web of interconnected wipes 50 which are folded in an accordion-like stacked configuration or a roll. The individual wipes can be connected together along lines of frangibility, such as lines of perforations, to ensure that the trailing wipe is in position for grasping by the user after the leading wipe is removed. For example, the wipes can be provided by a continuous web of material which has a series of lines of frangibility extending across the width of the web. The portion of the web of material between successive lines of frangibility provides each individual wipe. The lines of frangibility can be provided by means known to those skilled in the art such as perforations, indentations or cuts in the web of material. For example, the lines of frangibility or perforations can be provided in the web of material by passing the web of material between a die cutter roll and an anvil roll. After the lines of frangibility have been incorporated into the web of material, the web can then be arranged in a stacked configuration for easy insertion into the dispenser during formation thereof.

Desirably, the individual wipes can be interfolded or continuously interconnected so that the leading and trailing edges of successive wipes in the stacked configuration will interact, for "pop-up" dispensing. In such a configuration, the leading edge of the trailing wipe is loosened from the stack by the trailing edge of the leading wipe as the leading wipe is removed by the user.

The container can include any suitable number of individual wipes depending upon the desired packaging and end use. For example, the container can be configured to include a stack of wipes which can include at least about 5 wipes and desirably from about 8 to about 320 individual wipes, and more desirably from about 16 to about 80 wipes. The size and shape of the stack of wipes is dependent upon the size and shape of the container and vice versa.

Each wipe is generally rectangular in shape and defines a pair of opposite side edges 61, 63 and a pair of opposite end edges which can be referred to as a leading edge 55 and a trailing edge 60. The leading edge 55 of each wet wipe is typically positioned in the dispenser within the dispensing orifice to be grasped by a user to facilitate a removal of the wipe from the container.

In an exemplary embodiment, the lid base 14 contains a rigid port 18 surrounding a pop-up style dispensing partition 40 wherein a flexible, rubber-like material having a slit or orifice 30 through which individual wet wipes are removed from the container. For pop-up dispensing, the wipe will become separated or disjointed from the subsequent adjacent second wipe at a separably joined interface (e.g., weakened line, adhesive joint, or other mechanism) after fully dispensing the first wipe and while a portion of the second wipe remains in the flexible orifice. The next wipe for dispensing may be automatically maintained in the orifice partially dispensed with a portion of the wipe extending from the dispensing aperture for later use (i.e., in a pop-up dispensing format). Alternatively, the following wipe may need to be fetched out of the inside of the dispenser similar to the first wipe at a later time when it is desired, commonly called reach-in dispensing, if the user pushed the following wipe back into the storage portion after pop-up dispensing of the leading or first wipe. In either case, after the desired number of wipes are taken, the top can be closed, with or without a wipe partially dispensed in the flexible orifice, as discussed previously. At a later time when another wipe(s) is desired, the preceding steps can generally be followed again.

In an exemplary embodiment, the dispensing partition 40 is a single unitary or undivided section of material. Use of a unitary section of material improves the moisture retention of the container. Other non-flexible materials have been used to provide similar arrangements. However, these non-flexible materials have been made with rigid plastic materials and are connected together using mechanical means. This creates larger spaces in the dispensing orifice where moisture can be lost into the atmosphere during storage and the wipes become overly dry.

A portion of the unitary dispensing partition extends into the interior of container base 25 in the z-direction. Typically, the unitary dispensing partition 40 forms an arc 35 in the x-direction extending a first depth, D1, into an interior 32 of the container 10 in a z-direction forming a storage space for a leading edge of the next wipe in a pop-up dispensing format. The geometry of the arc 35 extending a depth of the container in the z-direction provides the opportunity to offer more "storage space" under the mini-lid for the leading edge of the wipe. This allows the consumer to easily access the wipe within the dispensing aperture with less dexterity or without looking at the container. Thus, a care giver, for example, could easily reach into the container and open the lid without taking their eyes off of an infant and looking directly at the container.

In an exemplary embodiment, the first depth, D1, of the unitary dispensing partition 40 extends into the interior of the container in the z-direction by a distance of at least 5 mm. More desirably, the first depth, D1, of the unitary dispensing partition 40 extends into the interior of the container in the z-direction by a distance of between about 5 and about 15 mm.

Typically, the dispensing aperture 60 may be a continuous slit 65 that extends a distance in an x-direction along the arc having two ends, 70, 75. The two ends 70, 75 of the continuous slit 65 are present on the arc 35 at a second depth, D2, in the z-direction which is less than the first depth, D1.

In exemplary embodiments, this allows the tear initiation to begin in the middle portion 90 of the wipe as the dispensing partition 40 makes contact with the trailing edge 65 of the first wipe in the middle portion 90 of the wipe. The geometry of the arc extending a depth of the container in the z-direction also provides improved control of the dynamics of sheet separation during dispensing by providing z-direction separation of the orifice feature that initiates perforation tear and the point on the orifice where the wipe first emerges from the orifice. The subsequent sheet is already gripped by the dispensing partition 40 in the middle of the sheet while the tear is continued on the sides of the wipe. This helps maintain the subsequent sheet in the dispensing partition 40 for future dispensing and prevents the subsequent wipe from falling back into the container 10.

Thus, the geometry of the dispensing partition 40 provides a unique "check valve" action that helps prevent short tails from the subsequent wipe from falling back into the container. Conventional flexible orifices are designed with all points of the orifice surface residing in the same plane. The conventional flat orifices provide no z-direction separation of tear initiation and initial emergence of the wipe leading edge through the orifice, and therefore offer less control of the separation process.

Alternatively, the tear initiation begins in the outer edge 61, 63 of the wipe as the dispensing partition 40 makes contact with the trailing edge 65 of the first wipe in the middle portion 90 of the wipe. The subsequent sheet is already gripped by the dispensing partition 40 in the middle of the sheet while the tear is continued towards the middle of the wipe. This helps maintain the subsequent sheet in the dispensing partition 40 for future dispensing and prevents the subsequent wipe from falling back into the container 10.

Additionally, when perforation tear is initiated at the upper corners of the dispensing partition's 40 inverted arc, the middle portion 90 of the leading edge of the subsequent wipe is already well past the opening of the orifice 60. This helps to insure that when separation is complete, the subsequent wipe is optimally staged for the next dispense.

Thus, the container with the arc-shaped dispensing orifice has improved dispensing with less dispensing failures caused by wipes falling back into the container, wipes tears or multiple wipes being pulled from the container in a single pull. The dispensing partition described herein typically has a dispensing failure rate of less than 8%.

As discussed above, the dispensing orifice 60 can be formed as a slit 65 in a dispensing partition 40 located beneath the lid top 15 that is formed from flexible or elastic material. The narrow slit 65 in the dispensing partition 40 can help to retain moisture in the wet wipes dispenser 10, securely hold the exposed portion of the wet wipe in place, and make it easier to reach into the wet wipes dispenser to retrieve the next wipe should the pop-up functionality fail since the elastomeric or flexible material can be readily deformed and then resume its original shape. Furthermore, a narrow slit with a wet wipe protruding from the slit effectively plugs the dispensing orifice 60, reducing any possible leakage of the wetting solution from the wet wipes dispenser when the wet wipes dispenser is inverted. The dispensing orifice 60 can be a slit having a sinusoidal middle portion with two legs extending in opposing directions from the middle portion as illustrated in FIG. 1. Alternatively, the dispensing orifice 60 can be another size and/or shape such as circular, oval, rectangular, H shaped, + shaped, star shaped, or other suitable shape. Preferably, the dispensing orifice 60 is restricted or reduced in size as compared to a dispensing surface area of the wet wipes stack 50, as shown in FIG. 1, in order to assist in separating successive wet wipes and to retain the wet wipes partially exposed from the dispensing orifice during upright dispensing.

Examples of flexible rubber-like materials used in the container of the present disclosure include thermoplastic elastomeric (TPE) materials that can be used to provide acceptable dispensing. Materials which can be employed include (but are not limited to): any of the family of styrenic-based TPE's (i.e., styrenic block copolymer compounds); styrenic-based TPE's containing rubber modifiers such as Kraton™, Santoprene™, or other rubber modifiers; specialty copolymers, such as ethylene-methyl acrylate copolymers (e.g. EMAC™ of the Eastman Chemical Company); thermoset rubbers; polyurethane; alloys; amides; engineering TPE's; olefinic-based; olefinic vulcanizates; polyester-based; polyurethane-based. One such material for the flexible, rubber-like sheet could be that manufactured by the GLS Corporation of McHenry, Ill. and known as resin #G2701. The G2701 material is one of the resins in the product family of TPEs. G2701 is a styrenic-based material and is in the family of Styrenic block copolymer compounds. Some particular properties of the G2701 can be: specific gravity of 0.90 g/cc (per ASTM D792); hardness (Shore A durometer) of 68 (ASTM D2240); and compression set of 24% at room temperature, 96% at 70° C. (per ASTM 395B). Another similar material is known as G2755 and also sold by GLS Corporation. In addition, a lubricant (e.g., wax) can be added to lower the coefficient of friction of the continuous slit which can benefit injection molding, wet wipes dispensing, and physical handling of the flexible orifice. The G2701 TPE resin with 0.25% wax additive sold by GLS Corporation and known as #LC217-189 can be used.

The properties of the dispensing partition may be described in terms of the hardness, stiffness, thickness, elasticity, specific gravity, compression set, and any combination thereof. More specifically, the Shore A hardness (as measured by ASTM D2240) of the flexible, rubber-like sheet or material can be about 100 or less, more specifically from about 20 to about 90, and still more specifically from about 40 to about 80, and yet more specifically from about 60 to about 70. The Gurley stiffness of the flexible, rubber-like sheet or material (as measured by ASTM D 6125-97 "Standard Test Method for Bending Resistance of Paper and Paperboard") can be about 10,000 milligrams of force (mgf) or less, more specifically from about 100 to about 8000 mgf, more specifically from about 200 to about 6500 mgf, and still more specifically from about 300 to about 1500 mgf. The thickness of the flexible, rubber-like sheet can be about 10 mg or greater, more specifically from about 10 mg to about 110 mg and still more specifically from about 35 mg to about 60 mg. The elasticity of the flexible rubber-like material or sheet, as characterized by the tensile stress at 100 percent elongation and measured in accordance with ASTM D412 "Standard Test Methods for Vulcanized Rubber and Thermoplastic Elastomers", can be about 10 megapascals (MPa) or less, more specifically from about 0.1 to about 7 MPa, and still more specifically from about 0.5 to about 2.5 MPa. The flexible rubber-like sheet can have a specific gravity (per ASTM D792) of about 0.80 to 1.21, more specifically 0.88 to about 1.10, and still more specifically from about 0.90 to about 1.0. The flexible rubber-like sheet can have a compression set (per ASTM 395B) of (at room temperature/at 70° F.) about 8/30 to 40/120 and more specifically 15/45 to about 28/100.

To enable access to the wipes stored within the container, the lid structure 12 includes a lid-activation button 30. After the lid-activation button 30 is pressed, the lid top 15 is released from the lid base allowing a user to access an opening into the container. The lid top 15 is secured in a closed position by a suitable lid latching mechanism engaged with a button latching mechanism. In exemplary embodiments, the lid latching mechanism includes a protrusion latch in the front edge of the lid top 15 that is engaged by a button latching mechanism including an aperture catch on the inner longitudinal edge of the lid-activation button 30. In other exemplary embodiments, the lid latching mechanism includes a protrusion latch in the front edge of the lid top that is engaged by a button latching mechanism including a protrusion catch in the inner longitudinal edge of the lid-activation button 30. In still other embodiments, the lid latching mechanism includes an aperture catch in the front edge of the lid top 15 that is engaged by the button latching mechanism including a protrusion latch on the inner longitudinal edge of the lid-activation button 30.

As used herein, rigidity means a level of stiffness commonly associated with materials used to manufacture containers containing wet wipes or parts thereof. Numerically, these materials typically have a flexural modulus (as measured in accordance with ASTM D790 "Standard Test Method for Flexural Properties of Unreinforced and Reinforced Plastics and Electrical Insulating Materials") of at least 100 Newtons per square millimeter. In particular embodiments, the lid-activation button has a flexural modulus of between about 1100 to about 1500 Newtons per square millimeter.

In use, the top of the dispenser is opened and then access to the flexible orifice is gained. The user then passes his or her hand through the continuous slit to grab the first wipe in the stack of wipes. If the orifice is a frangible seal, this must be broken before the user can pass his or her hand through the orifice. Once the user grabs the wipe, it can then pass through the orifice and out of the dispenser as the user pulls it up. If the user does not immediately need the wipe, it can be left in the orifice partially dispensed where it can be maintained in place by the continuous slit until desired later. The partially dispensed wipe will just rest in place in the orifice, part inside the dispenser and part in the space between the top and the flexible orifice, conveniently ready for later dispensing in the pop-up format. If the user does immediately desire to use the wipe, he or she can pull the complete wipe through the continuous slit and out of the dispenser.

Materials suitable for the wipes of the present disclosure are well known to those skilled in the art. For wet wipes, these can be made from any material suitable for use as a moist wipe, including meltblown, coform, air-laid, bonded-carded web materials, hydroentangled materials, high wet-strength tissue, and the like, and can comprise synthetic or natural fibers or combinations thereof. The wipes of the different aspects of the present disclosure can contain a liquid which can be any solution which can be absorbed into the wipes, thus making them "wet wipes." The liquid contained within the wet wipes can include any suitable components which provide the desired wiping properties. For example, the components can include water, emollients, surfactants, preservatives, chelating agents, pH buffers, fragrances, or combinations thereof. The liquid can also contain lotions, ointments and/or medicaments. The amount of liquid contained within each wet wipe can vary depending upon the type of material being used to provide the wet wipe, the type of liquid being used, the type of container being used to store the stack of wet wipes, and the desired end use of the wet wipe. Generally, each wet wipe can contain from about 15 to about 600 weight percent and desirably from about 200 to about 400 weight percent liquid based on the dry weight of the wipe for improved wiping.

Accordingly, the different aspects and features of the present disclosure can provide containers for wipes which, when compared to conventional containers for wipes, provide improved same container storage and dispensing. Such containers are particularly useful for dispensing baby wipes since the caregiver typically only has one hand free during the diapering process. The packages for wipes, e.g., wet wipes, of the present disclosure are reliably and easily opened by one hand of the user or care giver for improved convenience and personal hygiene since the wipe will more likely be in the dispensing partition 40. Additionally, the packages of the present disclosure can provide better, more consistent dispensing.

EXAMPLE

The performance of the arc-shaped dispensing partition can be measured more directly by demonstrating the dispensing consistency of the dispenser. To illustrate the improved dispensing partition, dispensing through the arc-shaped dispensing partition was compared to a conventional planar dispensing partition.

To determine the dispensing efficiency, containers as described herein were tested including containers with the arc-shaped dispensing partition and containers with a planar dispensing partition. Three separate stacks of 42 KLEENEX® COTTONELLE FRESH® Folded Wipes (Commercially available from Kimberly-Clark Corporation of Neenah, Wis.) were pulled manually from the containers to calculate a dispensing failure rate. The separate stacks of wipes included three clips or sets of 14 wipes connected by perforations, with each subsequent clip connected by an adhesive. A dispensing failure is defined as a tear, a fall back or a multiple pull through. A tear is a wipe tearing as it is pulled through the partition. A fall back is the subsequent wipe falling back into the interior of the container. A multiple pull through is defined as more than a single wipe being pulled from the container with a single pull. Each time any of these actions occurred it was considered a dispensing failure. The percentage of dispensing failures is calculated as the number of dispensing failures divided by the number of wipes in the stack.

TABLE 1

Dispensing Failure Rates

| | Arc-Shaped Dispensing Partition | Planar Dispensing Partition |
|---|---|---|
| Run #1 Failure Rate (%) | 5.2 | 10.3 |
| Run #2 Failure Rate (%) | 5.2 | 12.7 |
| Run #3 Failure Rate (%) | 6.7 | 12.3 |
| Average Failure Rate (%) | 5.70 | 11.76 |

Table 1 illustrates that containers having an arc-shaped dispensing partition as defined herein have less dispensing failures than containers having planar dispensing partitions. The arc-shaped dispensing partition is shown to have a dispensing failure rate of about 5.7%.

While the container useful for purposes of this present disclosure has been specifically illustrated in the figures, those skilled in the art will appreciate that many different container designs are possible, including canister style containers, without departing from the scope of the invention. It will be appreciated that the foregoing description, given for purposes of illustration, is not to be construed as limiting the scope of the present disclosure, which is defined by the following claims and all equivalents thereto.

What is claimed is:

1. A container for storing personal care articles comprising:

a lid structure attached to the container, the lid structure having a top lid portion connected to a base lid portion by at least one hinge, the base lid portion including a rigid port surrounding a unitary dispensing partition, the unitary dispensing partition having a dispensing aperture formed therethrough, the unitary dispensing partition formed of a flexible, rubber-like material;

wherein the unitary dispensing partition forms a rectangular symmetrical arc extending a first depth into an interior of the container in a z-direction;

wherein the dispensing aperture comprises a continuous slit comprising a plurality of convolutions and having at least two ends, the continuous slit extending a distance in an x-direction along the arc, the x-direction being perpendicular to the z-direction.

2. The container of claim 1 wherein the first depth of the unitary dispensing partition extends into the interior of the container in the z-direction by a distance of at least 5 mm.

3. The container of claim 1 wherein the first depth of the unitary dispensing partition extends into the interior of the container in the z-direction by a distance between about 5 and about 15 mm.

4. The container of claim 1 wherein the container has a dispensing failure rate of less than 8%.

5. The container of claim 1 wherein the at least two ends of the continuous slit reside on the arc at a second depth in the z-direction which is less than the first depth.

6. The container of claim 1 further comprising a stack of wet wipes located inside of the wet wipes container, each wet wipe having a leading edge and a trailing edge, wherein each leading edge and each trailing edge of each wet wipe in the stack extends in the x-direction.

7. The container of claim 6 wherein the leading edge of the wipe extends into a storage space between the dispensing partition and the lid top.

8. The container of claim 1 wherein the dispensing partition is a thermoplastic elastomer.

9. A container for storing personal care articles comprising:

a lid structure attached to the container, the lid structure having a top lid portion connected to a base lid portion by at least one hinge, the base lid portion including a rigid port surrounding a unitary dispensing partition, the unitary dispensing partition having a dispensing aperture formed therethrough, the unitary dispensing partition formed of a flexible, rubber-like material;

wherein a portion of the unitary dispensing partition extends in a rectangular symmetrical arc a first depth into an interior of the container in a z-direction;

wherein the dispensing aperture comprises a continuous slit comprising a plurality of convolutions and having at least two ends, the continuous slit extending a distance in an x-direction along the arc, the x-direction being perpendicular to the z-direction.

10. The container of claim 9 further comprising a stack of wet wipes located inside of the wet wipes container, each wet wipe having a leading edge and a trailing edge, wherein each leading edge and each trailing edge of each wet wipe in the stack extends in the x-direction.

11. The container of claim 9 wherein the first depth of the unitary dispensing partition extends into the interior of the container in the z-direction by a distance of at least 5 mm.

12. The container of claim 9 wherein the first depth of the unitary dispensing partition extends into the interior of the container in the z-direction by a distance between about 5 and about 15 mm.

13. The container of claim 9 wherein the dispensing partition is a thermoplastic elastomer.

14. The container of claim 9 wherein the container has a dispensing failure rate of less than 8%.

* * * * *